US007150603B2

(12) United States Patent
Lee et al.

(10) Patent No.: US 7,150,603 B2
(45) Date of Patent: Dec. 19, 2006

(54) COMPRESSOR

(75) Inventors: Jaehoon Lee, Daejeon-si (KR); Jeonghun Seo, Daejeon-si (KR); Haksoo Kim, Daejeon-si (KR); Hewnam Ahn, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 11/212,954

(22) Filed: Aug. 26, 2005

(65) Prior Publication Data

US 2006/0045763 A1 Mar. 2, 2006

(30) Foreign Application Priority Data

Aug. 31, 2004 (KR) ..... 10-2004-0069203
Aug. 22, 2005 (KR) ..... 10-2005-0076591

(51) Int. Cl.
*F04B 1/16* (2006.01)
*F04B 39/02* (2006.01)

(52) U.S. Cl. ..... 417/312; 417/269

(58) Field of Classification Search ..... 417/222.2, 417/269, 312

See application file for complete search history.

(56) References Cited

U.S. PATENT DOCUMENTS 4,432,446 A 2/1984 Okano et al.
5,062,773 A * 11/1991 Kawai et al. ..... 417/269
5,971,716 A * 10/1999 Ota et al. ..... 417/222.2
6,386,846 B1 * 5/2002 Murase et al. ..... 417/222.2
6,488,481 B1 * 12/2002 Nagai et al. ..... 417/312
6,851,937 B1 * 2/2005 Choi et al. ..... 417/269
7,000,420 B1 * 2/2006 Ahn et al. ..... 417/312
2004/0091370 A1 * 5/2004 Yoon et al. ..... 417/269

* cited by examiner

*Primary Examiner*—Michael Koczo, Jr.
(74) *Attorney, Agent, or Firm*—Fulbright & Jaworski L.L.P.

(57) ABSTRACT

The present invention relates to a compressor for sucking, compressing and discharging a refrigerant gas from the external refrigerant circuit. The compressor includes: a suction muffler chamber having a suction port formed on the outer circumference of a cylinder block, which has a plurality of bores arranged in a line, and an oil storing part for storing oil, the suction port being communicated with the external refrigerant circuit; and a rear housing connected to the cylinder block to close the rear end of the cylinder block and having a suction chamber and a discharge chamber therein, the rear housing having a suction chamber communicating passage for communicating the suction chamber with the suction muffler chamber at the upstream part of the suction chamber. The compressor can effectively reduce a pressure pulsation of the suction gas and a noise due to the pressure pulsation without causing an increase of the overall length and the entire volume of the compressor, improve lubrication at the time of an initial start, and increase suction and compression efficiencies.

13 Claims, 7 Drawing Sheets

PRIOR ART

PRIOR ART

COMPRESSOR

BACKGROUND OF THE INVENTION

This application claims priority from Korean Patent Application No. 2004-69203 filed Aug. 31, 2004 and Korean Patent Application No. 2005-76591 filed Aug. 22, 2005, incorporated herein by reference in their entireties.

1. Field of the Invention

The present invention relates to a compressor applied to an air conditioner of a car, and more particularly, to a compressor which is provided with a single-headed piston, thereby reducing a pressure pulsation of a suction gas.

2. Background of the Related Art

In general, in a compressor applied to an air conditioner of a car, noise is generated due to a pressure pulsation of a suction gas or a discharge gas. At this time, particularly, the noise transferred to the inside of the car through an evaporator is transferred along a suction line, and so, it is necessary to reduce the pressure pulsation of the suction gas in order to reduce the noise transferred to the inside of the car.

In particular, a variable capacity type compressor generates much noise due to the pressure pulsation of the suction gas or discharge gas than a fixed capacity type compressor since the variable capacity type compressor is driven for a long time in a low flow state and a low lubrication state. So, the variable capacity type compressor needs a structure for reducing the noise.

In the conventional variable capacity type compressor applied to the air conditioner of the car, which has a single-headed piston, as the structure for reducing the pressure pulsation of the suction gas or discharge gas, for example, as shown in FIG. 1, suction and discharge muffler chambers 2 and 4 whose open portions are opposed to each other are respectively mounted on the outer circumferences of a cylinder block 1 and a rear housing 3, and edges of open ends of the muffler chambers 2 and 4 are sealed by a mutual bonding so as to secure a sufficient muffler space necessary for relieving the pressure pulsation of the suction gas or discharge gas without causing an increase of the overall length of the compressor.

Such conventional muffler structure prevents the increase of the overall length of the compressor, but it is unavoidable that the housing is expanded and the entire volume of the compressor is increased since the muffler space is formed on the outer circumference of the housing. With the above reason, the conventional muffler structure is improper as a muffler structure of a vehicle compressor which strictly requires a small size and a light weight.

To solve the above problem of the conventional compressor, Korean Patent Publication No. 2004-0021062 filed by the same applicant as the present invention discloses a compressor. Referring to FIG. 2, the prior art will be described only about parts contrasted with FIG. 1 in brief. As shown in the drawing, the compressor includes: a suction muffler chamber 11 formed on the outer circumference of a cylinder block 10 and having a suction port 12 communicating with the external refrigerant circuit; a discharge chamber 16 and a suction chamber formed inside a rear housing 15; and at least two suction passages 18 formed on the upstream portion of the suction chamber 17 for communicating the suction chamber 17 with the suction muffler chamber 11.

Furthermore, a valve plate 19 is interposed between the cylinder block 10 and the rear housing 15, and has at least one communicating hole 19*a* for communicating the suction passages 18 with the suction muffler chamber 11.

Refrigerant gas induced into the suction muffler chamber 11 through the suction port 12 from the external refrigerant circuit is sucked into the suction chamber 17 through the suction passages 18 formed in the rear housing 15. The sucked refrigerant gas is compressed according to operation of a single-headed piston 13 and a driving shaft 14, discharged to the discharge chamber 16 through a discharge hole 19*b*, and then, flown to the external refrigerant circuit through the discharge port 16*a*.

Therefore, the compressor does not cause the increase of the overall length and the entire volume thereof, and can effectively reduce the pressure pulsation of the suction gas and the noise caused by the pressure pulsation.

However, the above conventional compressors do not have any structure for storing oil contained in suction gas, and so, have several problems in that lubrication of the whole compressor is deteriorated due to a lack of the oil at the time of an initial start after the compressor is turned off and a noise is generated due to the deterioration of the lubrication.

That is, if refrigerant inside the compressor is heated by external heat or stagnated for a predetermined time period when the compressor is turned off, the oil is separated from the refrigerant and collected in a part. By the above, the oil is insufficiently supplied to the suction chamber when the compressor is turned on, and so, the noise is generated due to friction of a valve and the valve plate.

Meanwhile, U.S. Pat. No. 5,062,773 discloses a swash plate type refrigerant compressor. In U.S. Pat. No. 5,062,773, a cylindrical separation chamber is formed in a suction passageway for separating oil from a refrigerant gas containing the oil and supplying the separated oil into a swash plate chamber, whereby a driving shaft and a member for supporting the driving shaft are lubricated.

However, in also the above structure, the swash plate type refrigerant compressor has the same problem as the above conventional compressors in that the oil is not supplied into the suction chamber so that the noise is generated due to friction of a valve and a valve plate.

SUMMARY OF THE INVENTION

Accordingly, the present device has been made in view of the above problems, and it is an object of the present invention to provide a compressor which can reduce a pressure pulsation and a noise due to the pressure pulsation without causing an increase of the overall length and the entire volume of the compressor.

It is another object of the present invention to provide a compressor which is provided with an oil storing part formed in a suction muffler chamber for more smoothly inducing a stored oil into a suction chamber at the time of an initial start of the compressor, thereby improving lubrication of the compressor and reducing a noise.

To achieve these objects and other advantages and in accordance with the purpose of the invention, as embodied and broadly described herein, the compressor comprises: a suction muffler chamber formed on the outer circumference of a compressor body and having a suction port communicating with the external refrigerant circuit and an oil storing part for storing oil; a cylinder block having a plurality of bores arranged in a line therein; a front housing coupled to the front end of the cylinder block and having a crank chamber; a driving shaft rotatably supported to the cylinder block and the front housing; a piston linked with a swash plate mounted on the driving shaft and performing a straight reciprocating motion inside the bore of the cylinder block;

and a rear housing connected to the cylinder block to close the rear end of the cylinder block and having a discharge chamber and a suction chamber, a suction chamber communicating passage for communicating the suction chamber with the suction muffler chamber at the upstream part of the suction chamber, whereby the oil stored in the oil storing part is supplied to the suction chamber passing through the suction chamber communicating passage when the compressor is started.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
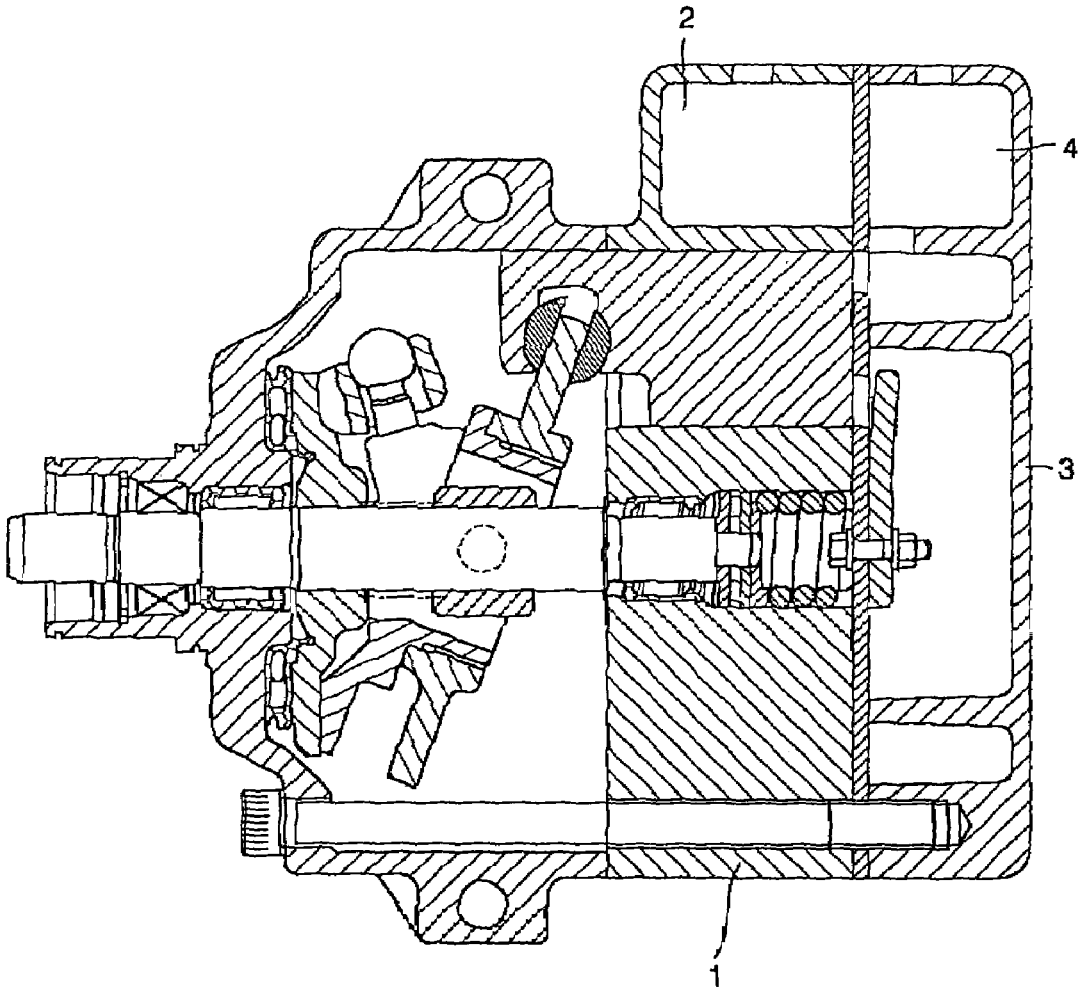
FIG. 1 is a sectional view of a conventional compressor.
Figure 2:
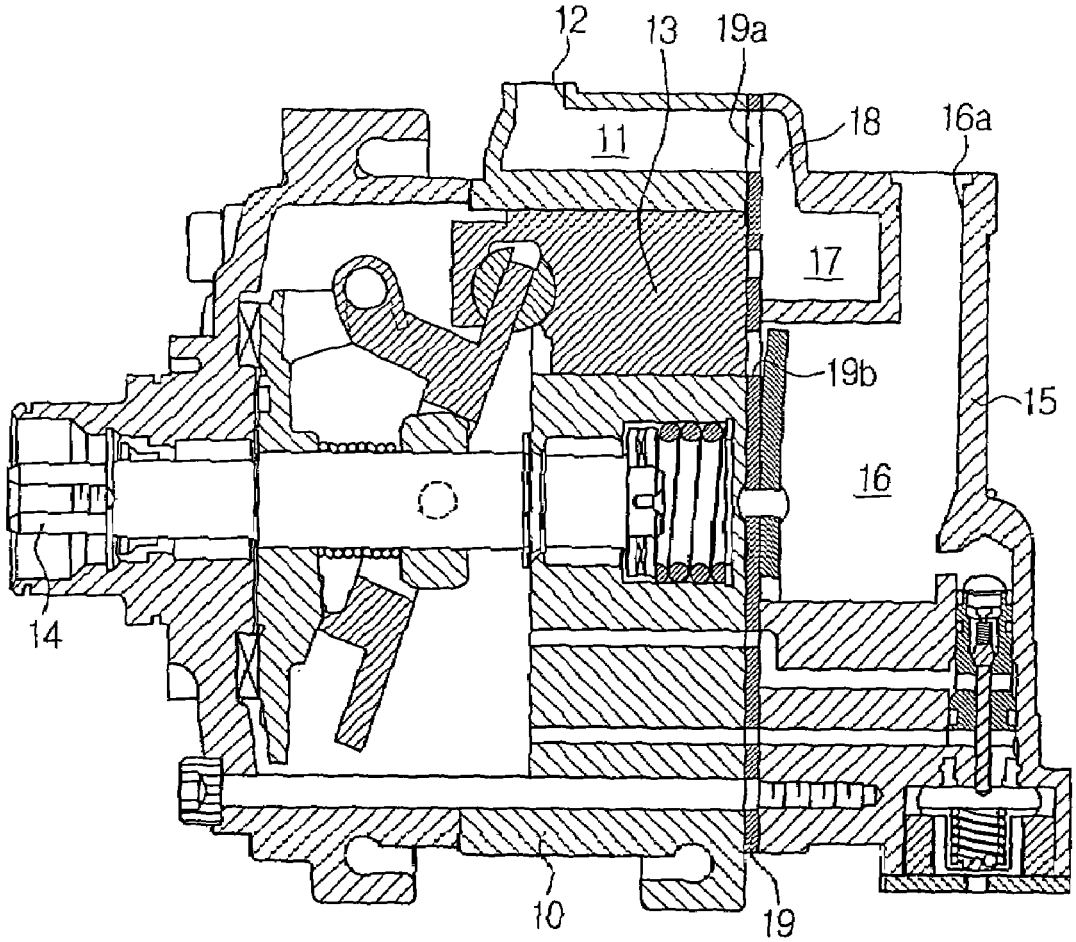
FIG. 2 is a sectional view of another conventional compressor.
Figure 3:
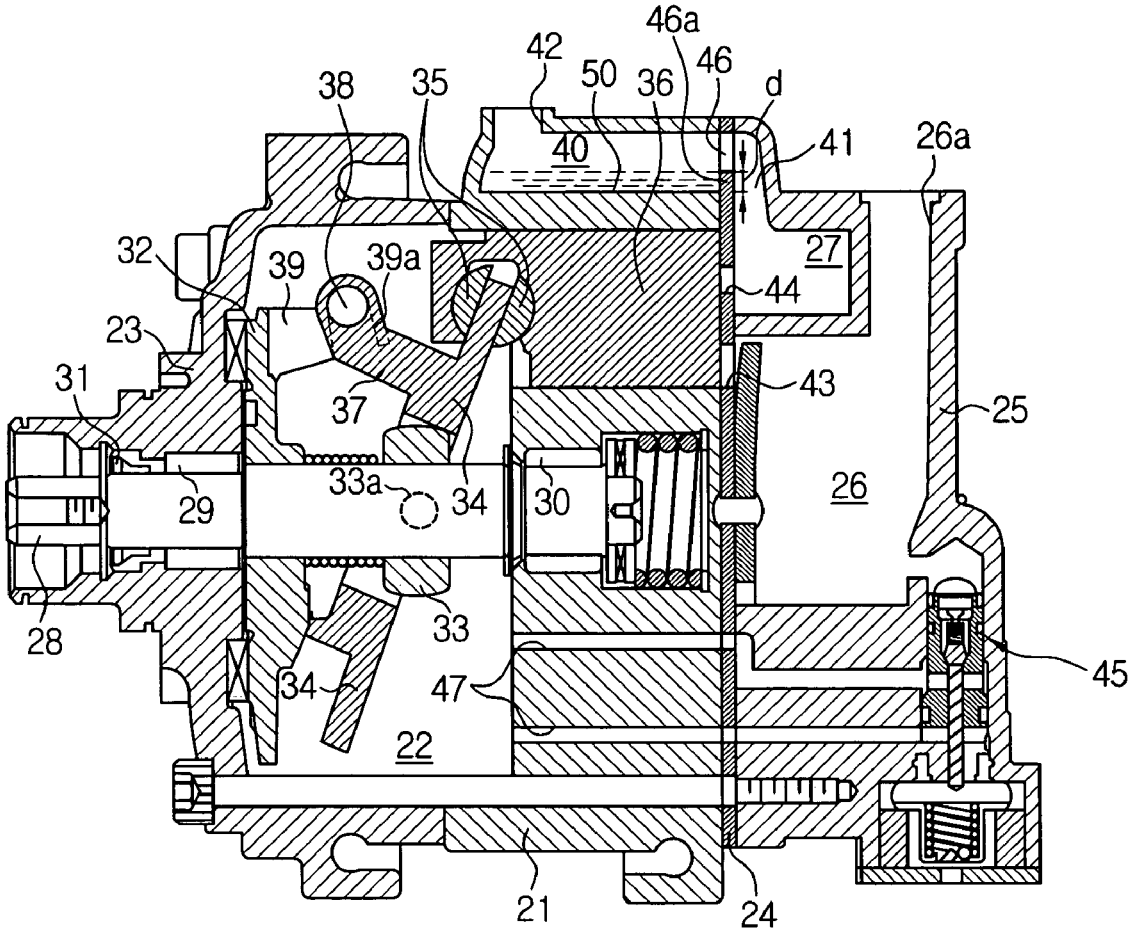
FIG. 3 is a sectional view of a compressor according to a first preferred embodiment of the present invention.
Figure 4:
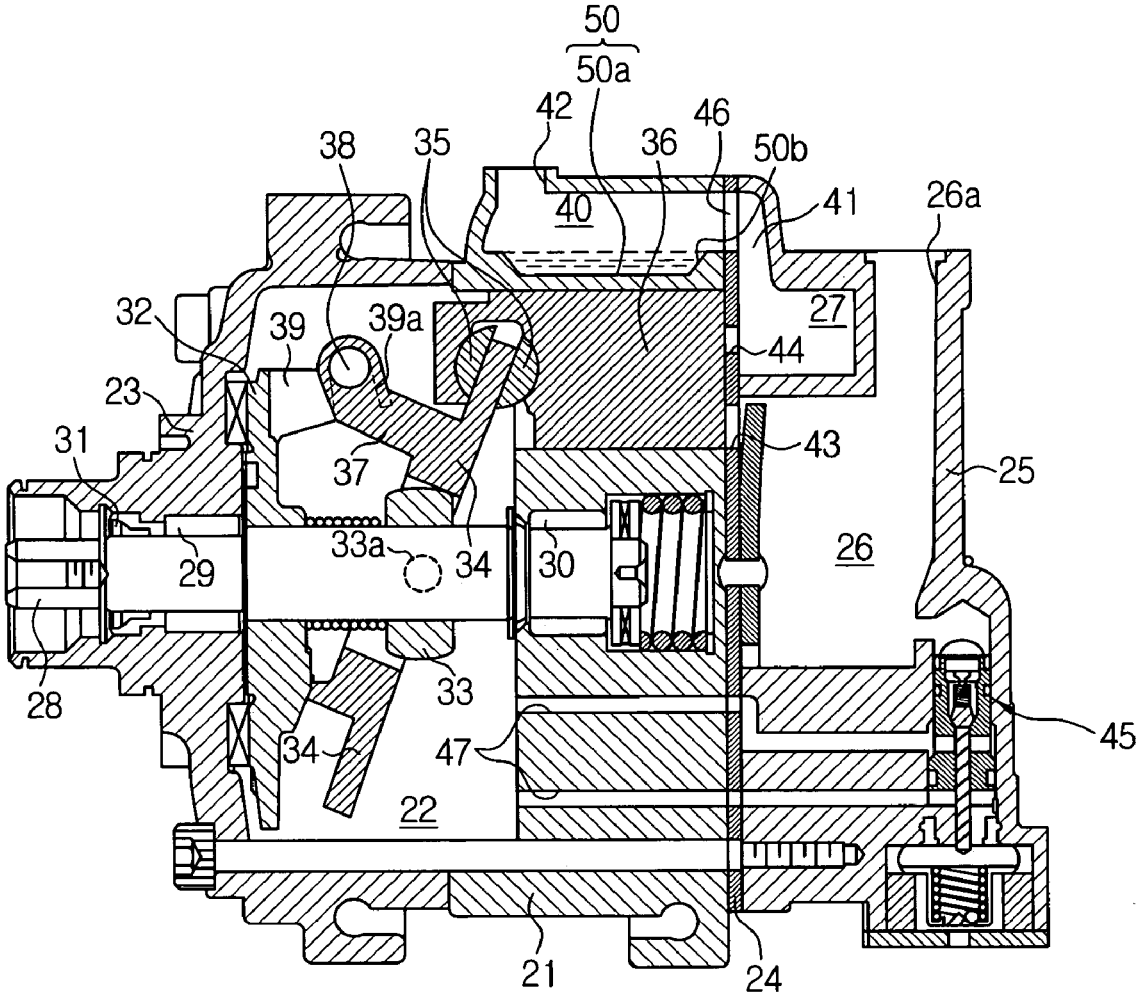
FIG. 4 is a sectional view of a compressor according to a second preferred embodiment of the present invention.
Figure 5:
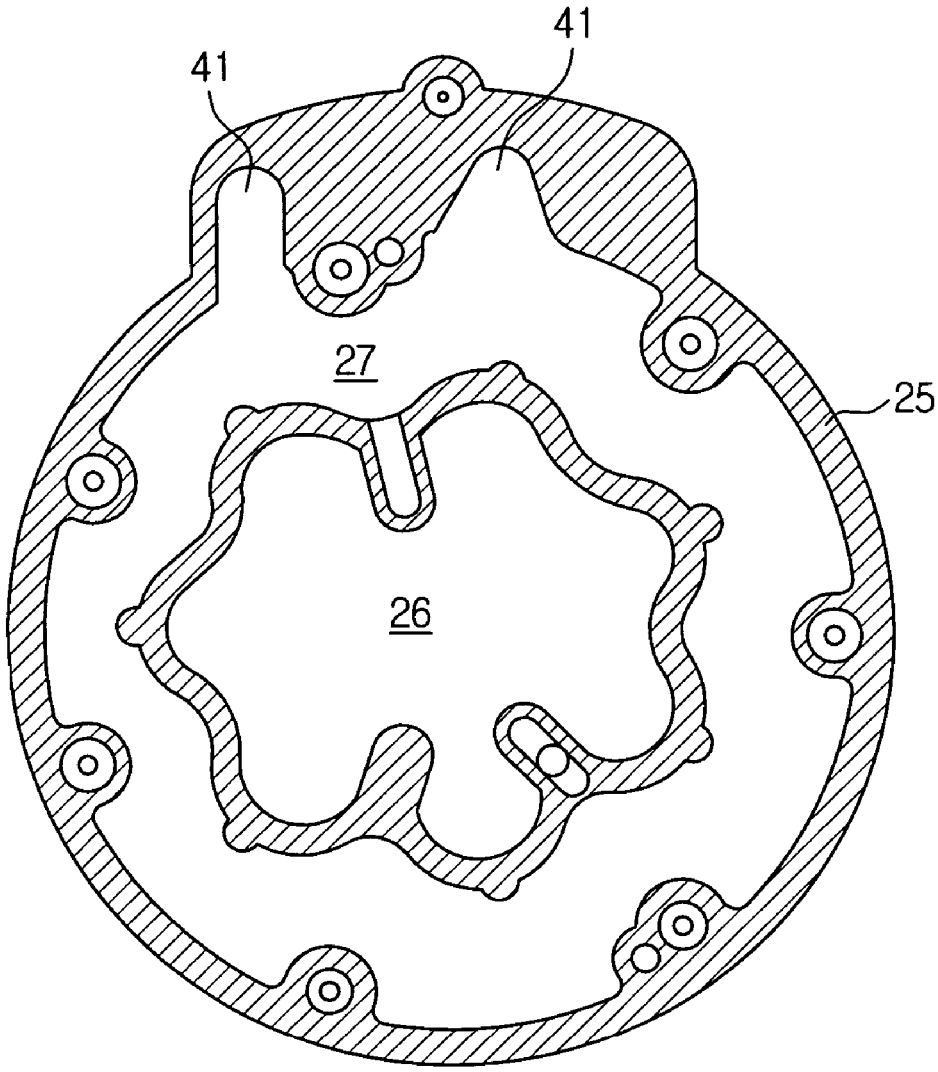
FIG. 5 is a view of a rear housing of the compressor according to the present invention.
Figure 6:
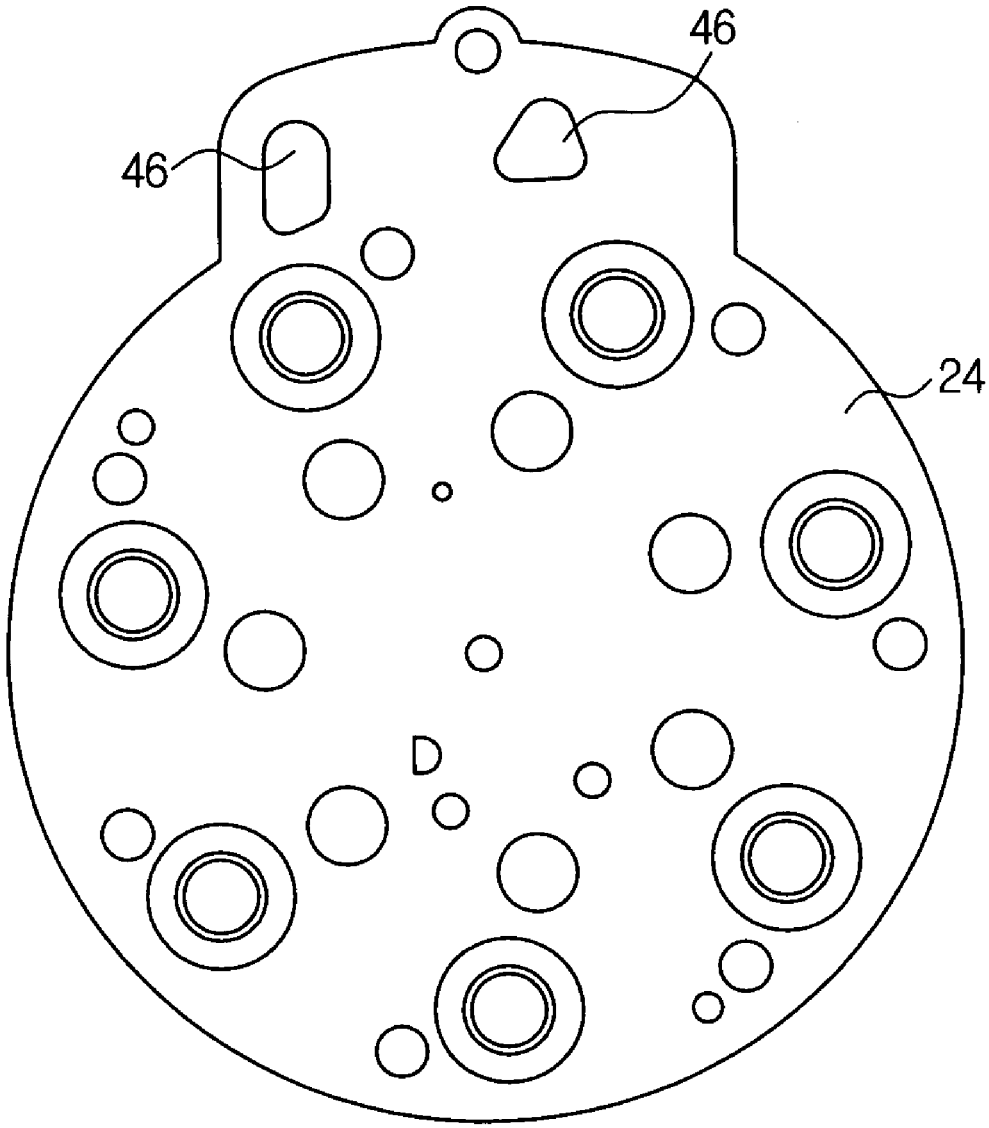
FIG. 6 is a view of a valve plate of the compressor according to the present invention.

FIG. 3 is a sectional view of a compressor according to a first preferred embodiment of the present invention, FIG. 4 is a sectional view of a compressor according to a second preferred embodiment of the present invention, FIG. 5 is a view of a rear housing of the compressor, and FIG. 6 is a view of a valve plate of the compressor according to the present invention.

Referring to the drawings, the front end of a cylinder block 21 provided with at least five bores which are arranged in a line is closed by a front housing 23 forming a crank chamber 22, and the rear end of the cylinder block 21 is closed by a rear housing 25 which is divided into a discharge chamber 26 formed in the inner area thereof and a suction chamber 27 formed in the outer area thereof. A valve plate 24 is interposed between the cylinder block 21 and the rear housing 25.

Here, the valve plate 24 is provided with a suction reed valve (not shown) and a discharge reed valve (not shown) which can open and close a suction hole 44 and a discharge hole 43.

Moreover, a shaft seal 31 is mounted on an extension part of the front housing 23 of a driving shaft 28 supported through radial bearings 29 and 30 on the front housing 23 and the cylinder 21. A rotor 32 is fit and fixed on the driving shaft 28 inside the crank chamber 22 for transferring a rotation of the driving shaft 28 to a swash plate 34. The rotor 32 is rotatably supported on the inner surface of the front housing 23.

Furthermore, a sleeve 33 is slidably fit on the driving shaft 28.

The sleeve 33 is provided with coupling holes 33*a* protruding from right and left sides thereof, and the swash plate 34 is provided with a fitting hole forcedly fit to the coupling hole 33*a* for allowing a tilting motion of the swash plate 34.

Moreover, a pair of hemispherical shoes 35 are faced with each other on a slide surface of the swash plate 34, and suspend the single-headed piston 36 onto the swash plate 34 by a spherical coupling with the single-headed piston 36 forcedly inserted into each of the bores.

On the front surface of the swash plate 34, a pair of hub arms 37 constituting a hinge unit extend at the top dead center of the swash plate 34, and a guide pin 38 is fit into each hub arm 37 and the rotor 32.

Meanwhile, a pair of support arms 39 constituting the hinge unit are mounted on the rear surface of the rotor 32, and the guide pin 38 is fit into a hole 39*a* formed through each support arm 39. By the above, the movement of the swash plate 34 is restricted, and a central inclination angle is set in the hole 39*a* of the support arm 39 in order to always maintain a position of the uppermost portion of the single-headed piston 36 in safe.

In addition, the rotor 32, the sleeve 33 and the swash plate 34 constitute an inclined plate part of the present invention.

In the drawings, the reference numeral 45 designates a volume control valve for properly controlling the volume of the refrigerant gas contained in the crank chamber 22 connected by a volume control passage 47.

A suction muffler chamber 40 which has a suction port 42 communicated with the external refrigerant circuit is formed on the outer circumference of the cylinder block 21, and the rear housing 25, as shown in FIG. 5, has at least one suction chamber communicating passages 41, for example, two suction chamber communicating passages 41 in the present invention, on the upstream part of the suction chamber 27 for communicating the suction chamber 27 with the suction muffler chamber 40.

It is preferable that the cross area of each suction chamber communicating passage 41 is smaller than that of an opening of the suction muffler chamber 40. Moreover, it is preferable that each of the suction chamber communicating passages 41 is vertical to the central axis of the suction chamber 27.

As described above, by forming at least two suction chamber communicating passages 41 in the rear housing 25, a flow rate of refrigerant gas is increased while the refrigerant gas induced from the suction muffler chamber 40 into the suction chamber 27 inside the rear housing 25 passes the suction chamber communicating passage 41 which has a sectional area smaller than the opening of the suction muffler chamber 40. Therefore, when the refrigerant gas is induced into the suction chamber 27 in the increased speed, the refrigerant gas can be supplied to the entire suction chamber 27 rapidly and evenly, so that a suction and compression efficiency of the refrigerant gas from the suction chamber 27 to the crank chamber 22 can be improved.

Furthermore, by forming at least two suction chamber communicating passages 41 in the rear housing 25, the flow of the refrigerant gas induced from the suction muffler chamber 40 into the suction chamber 27 can be dispersed, so as to prevent an increase of the pressure drop amount of the refrigerant gas.

It is preferable that the valve plate 24 is interposed between the cylinder block 21 and the rear housing 25 as shown in FIG. 6.

Moreover, it is preferable that the valve plate 24 has at least one communicating hole 46 for communicating the suction muffler chamber 40 with the suction chamber communicating passage 41.

It is preferable that the communicating hole 46 of the valve plate 24 is formed in the same shape as the suction chamber communicating passage 41 so that the refrigerant gas passing the communicating hole 46 of the valve plate 24 smoothly passes the suction chamber communicating passage 41 and is smoothly induced into the suction chamber 27.

Meanwhile, the suction port 42 formed on the suction muffler chamber 40 is communicated with the external refrigerant circuit. At this time, it is preferable that the suction port 42 is formed toward the front housing 23 at a long distance from the suction chamber communicating passage 41, for example, at least more than 20 mm away from the suction chamber communicating passage 41.

By the above, the refrigerant gas induced from the external refrigerant circuit into the suction muffler chamber 40 can be smoothly flown into the suction chamber 27 of the rear housing 25 without stagnation so as to prevent the pressure drop of the refrigerant gas.

Additionally, an oil storing part 50 for storing oil contained in the refrigerant gas induced through the suction port 42 is formed inside the suction muffler chamber 40.

That is, when the compressor is started, the oil contained in the refrigerant gas is bumped against the inner wall surface of the suction muffler chamber 40 and runs down, and then, is stored in the oil storing part 50.

The stored oil remains in the oil storing part 50 when the compressor is turned off, and during the initial start of the compressor, is supplied to the suction chamber 27 which is short of the oil along the sucked refrigerant. The oil supplied to the suction chamber 27 forms an oil film on the valve plate 24 or the discharge/suction reed valve, so that a noise such as a contact sound generated when the valve (not shown) is operated is reduced. Meanwhile, a part of the oil supplied to the suction chamber 27 is induced into the crank chamber 22 in order to lubricate a sliding part so as to improve the lubrication of the compressor when the compressor is started.

In the first preferred embodiment, as shown in FIG. 3, the oil storing part 50 has a protrusion 46*a* formed on an outlet of the suction muffler chamber 40 to store the oil.

Here, the protrusion 46*a* is formed in such a way as to form the communicating hole 46 of the valve plate 24 smaller than an area of the outlet of the suction muffler chamber 40.

Therefore, the oil storing part 50 is formed on the lower part of the suction muffler chamber 40 by the protrusion 46*a*, and the oil contained in the refrigerant gas passing the suction muffler chamber 40 is stored therein. Furthermore, the oil stored in the oil storing part 50 is induced into the suction chamber 27 along the suction refrigerant passing the suction muffler chamber 40 when the compressor is started.

Moreover, in case where the oil storing part 50 is formed by the protrusion 46*a*, since a height (d) of the protrusion 46*a* can be easily adjusted by controlling a size of the communicating hole 46, a size (height) of the oil storing part 50 also can be easily adjusted.

Here, it is preferable that the height (d) of the protrusion 4*a* is set as high as the oil stored in the oil storing part 50 so that the oil can be induced into the suction chamber 27 along the sucked refrigerant when the compressor is started. That is, it is preferable that the height (d) of the protrusion 4*a* is about 5 mm.

Meanwhile, the protrusion 46*a* may form an inclined surface toward the oil storing part 50 so that the oil stored in the oil storing part 50 can be more smoothly induced into the suction chamber 27 when the compressor is started.

Additionally, in the second preferred embodiment, as shown in FIG. 4, the oil storing part 50 may form an oil storing recess 50*a* at the lower part of the suction muffler chamber 40 of the cylinder block 21.

At this time, it is preferable that the oil storing recess 50*a* is provided with an upwardly inclined surface 50*b* directed toward the suction chamber 27 so that the oil stored in the oil storing recess 50*a* is more smoothly induced into the suction chamber 27 when the compressor is started.

Figure 7:
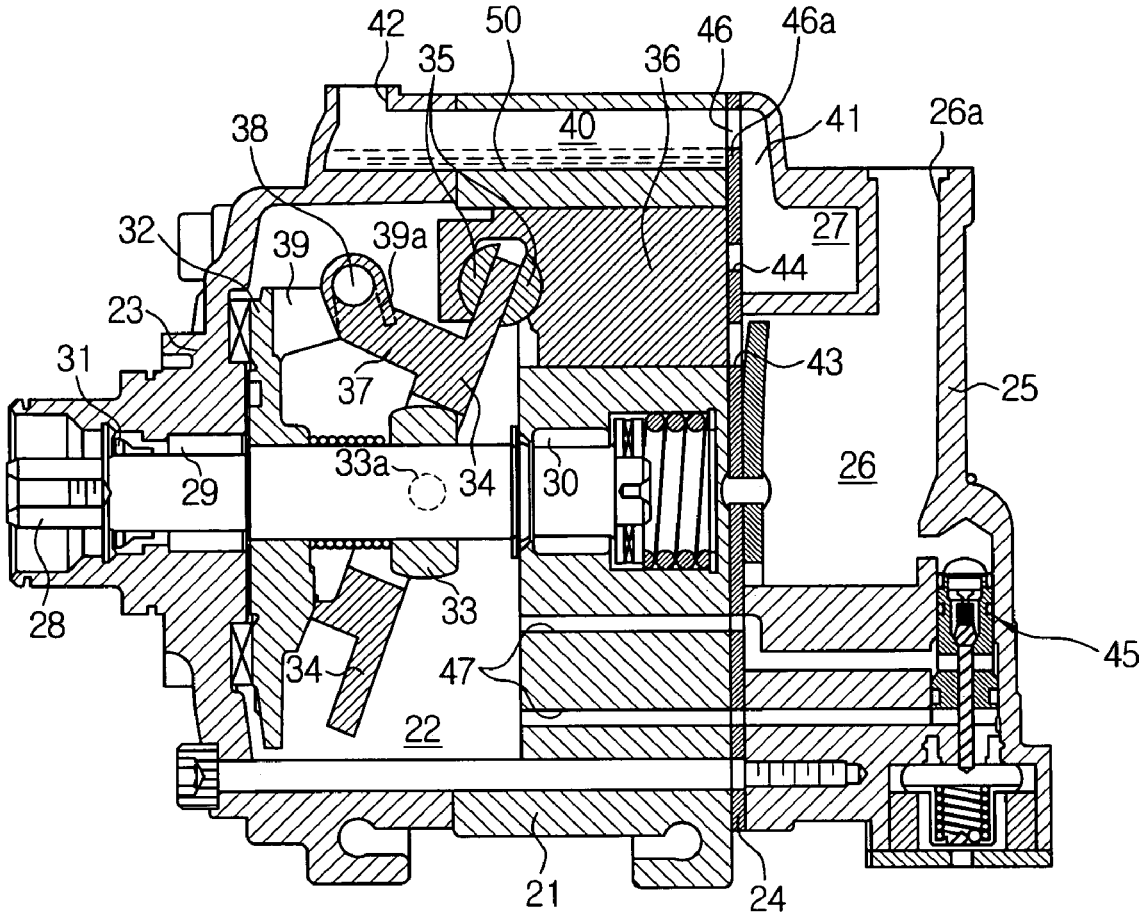
FIG. 7 is a sectional view of a compressor according to a third preferred embodiment of the present invention.

FIG. 7 is a sectional view of a compressor according to a third preferred embodiment of the present invention. The suction muffler chamber 40 may be formed on the cylinder block 21 as shown in FIGS. 3 and 4, but may extend between the front housing 23 and the cylinder block 21 as shown in FIG. 7.

As described above, in the present invention, the suction muffler chamber 40 may be formed on the outer circumference of the compressor in one of various shapes, and also a size of the oil storing part 50 may be freely adjusted.

Hereinafter, the operation of the present invention will be described in more detail.

The refrigerant gas induced from the external refrigerant circuit into the suction muffler chamber 40 through the suction port 42 is sucked into the suction chamber 27 in the rear housing 25 through the suction chamber communicating passage 41 formed in the rear housing 25.

At this time, some oil contained in the refrigerant gas passing the suction muffler chamber 40 is stored in the oil storing part 50.

As described above, the refrigerant gas sucked into the suction chamber 27 is compressed according to the operation of the single-headed piston 36 and the driving shaft 28, discharged to the discharge chamber 26 through the discharge hole 43, and then, is flown out to the external refrigerant circuit through the discharge port 26*a*.

As described above, the present invention can reduce a pressure pulsation and a noise due to the pressure pulsation without causing an increase of the overall length and the whole volume of the compressor.

Furthermore, according to the present invention, the refrigerant gas is induced from the suction muffler chamber into the suction chamber rapidly and evenly, whereby the suction and compression efficiency of the refrigerant gas can be improved.

Additionally, according to the present invention, the oil storing part is formed in the suction muffler chamber for more smoothly inducing the stored oil into the suction chamber at the time of the initial start of the compressor, whereby the lubrication at the time of the initial start of the compressor is improved and the noise due to friction of components of the suction chamber, such as the valve and the valve plate, is considerably reduced.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A compressor comprising:

a cylinder block having a plurality of bores arranged in a line therein;

a front housing coupled to the front end of the cylinder block and having a crank chamber;

a driving shaft rotatably supported to the cylinder block and the front housing;

a piston linked with a swash plate mounted on the driving shaft and performing a straight reciprocating motion inside the bore of the cylinder block;

a suction muffler chamber formed on the outer circumference of a compressor body, the suction muffler chamber having a suction port communicating with an external refrigerant circuit and an oil storing part capable of storing oil a in horizontal state of the driving shaft;

a rear housing connected to the cylinder block to close the rear end of the cylinder block and having a discharge chamber and a suction chamber therein, the rear housing further having a suction chamber communicating passage for communicating the suction chamber with the suction muffler chamber at the upstream part of the suction chamber, whereby the oil stored in the oil storing part is supplied to the suction chamber passing through the suction chamber communicating passage when the compressor is started.

2. A compressor according to claim 1, wherein a valve plate is interposed between the cylinder block and the rear housing, and has a communicating hole for communicating the suction chamber communicating passage with the suction muffler chamber.

3. A compressor according to claim 2, wherein the oil storing part has a protrusion formed at an outlet of the suction muffler chamber for storing oil therein.

4. A compressor according to claim 3, wherein the protrusion is formed in such a way that the communicating hole of the valve plate is formed smaller than the outlet area of the suction muffler chamber.

5. A compressor according to claim 3, wherein a height of the protrusion is set as high as the oil stored in the oil storing part so that the oil can be induced into the suction chamber along with the sucked refrigerant when the compressor is started.

6. A compressor according to claim 1, wherein a valve plate is interposed between the cylinder block and the rear housing, and has a communicating hole for communicating the suction chamber communicating passage with the suction muffler chamber; and the oil storing part has an oil storing recess formed at the lower part of the suction muffler chamber of the cylinder block, the lower part of the suction muffler is lower than the communicating hole.

7. A compressor according to claim 6, wherein the oil storing recess has an upwardly inclined surface directed toward the suction chamber.

8. A compressor comprising:

a suction muffler chamber formed on the outer circumference of a compressor body, the suction muffler chamber having a suction port communicating with an external refrigerant circuit and an oil storing part having a protrusion formed at an outlet of the suction muffler chamber for storing oil therein;

a cylinder block having a plurality of bores arranged in a line therein;

a front housing coupled to the front end of the cylinder block and having a crank chamber;

a driving shaft rotatably supported to the cylinder block and the front housing;

a piston linked with a swash plate mounted on the driving shaft and performing a straight reciprocating motion inside the bore of the cylinder block; and a rear housing connected to the cylinder block to close the rear end of the cylinder block and having a discharge chamber and a suction chamber therein, the rear housing further having a suction chamber communicating passage for communicating the suction chamber with the suction muffler chamber at the upstream part of the suction chamber, whereby the oil stored in the oil storing part is supplied to the suction chamber passing through the suction chamber communicating passage when the compressor is started.

9. A compressor according to claim 8, wherein a valve plate is interposed between the cylinder block and the rear housing, and has a communicating hole for communicating the suction chamber communicating passage with the suction muffler chamber.

10. A compressor according to claim 8, wherein the protrusion is formed in such a way that the communicating hole of the valve plate is formed smaller than the outlet area of the suction muffler chamber.

11. A compressor according to claim 8, wherein a height of the protrusion is set as high as the oil stored in the oil storing part so that the oil can be induced into the suction chamber along with the sucked refrigerant when the compressor is started.

12. A compressor comprising:

a suction muffler chamber formed on the outer circumference of a compressor body, the suction muffler chamber having a suction port communicating with an external refrigerant circuit and an oil storing part for storing oil;

a cylinder block having a plurality of bores arranged in a line therein;

a front housing coupled to the front end of the cylinder block and having a crank chamber;

a driving shaft rotatably supported to the cylinder block and the front housing;

a piston linked with a swash plate mounted on the driving shaft and performing a straight reciprocating motion inside the bore of the cylinder block; and a rear housing connected to the cylinder block to close the rear end of the cylinder block and having a discharge chamber and a suction chamber therein, the rear housing further having a suction chamber communicating passage for communicating the suction chamber with the suction muffler chamber at the upstream part of the suction chamber, wherein a valve plate is interposed between the cylinder block and the rear housing, and has a communicating hole for communicating the suction chamber communicating passage with the suction muffler chamber; and the oil storing part has an oil storing recess formed at the lower part of the suction muffler chamber of the cylinder block, the lower part of the suction muffler is lower than the communicating hole, whereby the oil stored in the oil storing part is supplied to the suction chamber passing through the suction chamber communicating passage when the compressor is started.

13. A compressor according to claim 12, wherein the oil storing recess has an upwardly inclined surface directed toward the suction chamber.

* * * * *